US006517020B1

(12) United States Patent
Smith

(10) Patent No.: US 6,517,020 B1
(45) Date of Patent: Feb. 11, 2003

(54) REPLACEABLE RAKER ASSEMBLY FOR PROCESSING TOOL OF WASTE PROCESSING MACHINE

(76) Inventor: Leward N. Smith, Rte. 11 Box 3650, Lake City, FL (US) 32024

( * ) Notice: Subject to any disclaimer, the term of this patent is extended or adjusted under 35 U.S.C. 154(b) by 0 days.

(21) Appl. No.: 09/658,481

(22) Filed: Sep. 8, 2000

(51) Int. Cl.[7] ..... B02C 13/28
(52) U.S. Cl. ..... 241/294; 241/300
(58) Field of Search ..... 241/291, 300, 241/294, 191, 195

(56) References Cited

U.S. PATENT DOCUMENTS

| | | | |
|---|---|---|---|
| 190,675 | A | 5/1877 | Gaines |
| 589,236 | A | 8/1897 | Williams |
| 604,283 | A | 5/1898 | Albrecht |
| 787,290 | A | 4/1905 | Griffin |
| 1,266,894 | A | 5/1918 | Williams |
| 1,559,924 | A | 11/1925 | Willcox |
| 1,713,507 | A | 5/1929 | Ammon |
| 1,752,290 | A | 4/1930 | Ammon |
| 1,761,083 | A | 6/1930 | Liggett |
| 1,889,129 | A | 11/1932 | Nielsen |
| 2,026,790 | A | 1/1936 | Mankoff |
| 2,128,194 | A | 8/1938 | Sheldon et al. |
| 2,244,577 | A | 6/1941 | Schreiber |
| 2,318,219 | A | 5/1943 | Harris |
| 2,392,958 | A | 1/1946 | Tice |
| 2,663,505 | A | 12/1953 | Sennholtz |
| 2,705,596 | A | 4/1955 | Poyser |

(List continued on next page.)

OTHER PUBLICATIONS

Wood Waste Disposal Problems: Bandit Has Some Answers!, Bandit Industries, Inc. Hard Hat News, Oct. 22, 1993.

The Beast, Model 30 Grinding Yard Waste, Model 15, Grinding Housing Demolition, Waste Handling Equipment News, Sep. 1994.

Bandit's Beast Maintains Nature's Beauty, Construction Equipment Guide, Jun. 1, 1994.

Bandit Industries, Inc., Reader Card 218, Forest Publications, Timber West, Nov. 1993.

Bandit Industries' Model 15–H Beast Recycler, Forest Products Equipment, Aug. 1994.

The Model 15 Beast, Bandit Industries, Inc., MSW Management, Mar./Apr. 1994.

Want to Lower the Cost of Breaking Down Yard and Other Landfill Waste?. . . Try the Beast from Bandit, Resource Recycling, Nov. 1994.

Turn Your Green Waste Into Green Dollars, Bandit Industries, Inc., Sportsturf, 1994.

"Product Release" for the new Model 15–H Beast Recycler Offered by Bandit Industries, Waste Handling Equipment New, Jun. 1994.

For Your Chipping and Grinding Needs, Bandit Industries, Inc., Forest Products Equipment, Aug. 1994.

Megagrind by Rexworks 800, 1995.

How to chop yard waste costs!, 1000 Commercial Grinder, Farmhand.

The Beast, Model 15–H, Bandit Industries, Inc.

The Beast Recyclers from Bandit Industries . . . with Big Appetites for Waste, Bandit Industries.

The Beast—Coming in the Summer of 1993 from Bandit Industries, Inc., Bandit Industries, Inc.

Maxigrind by Rexworks, The Most Versatile Materials Processing Machine.

Industrial Grinder, Big Bite, Manfactured by Haybuster.

*Primary Examiner*—Mark Rosenbaum
(74) *Attorney, Agent, or Firm*—Bliss McGlynn, P.C.

(57) ABSTRACT

A replaceable raker assembly for a processing tool of a waste processing machine includes a tool holder for attachment to a rotor assembly of the waste processing machine. The replaceable raker assembly also includes a raker removably attached to the tool holder to rake reduced waste material.

19 Claims, 3 Drawing Sheets

U.S. PATENT DOCUMENTS 2,710,635 A 6/1955 Alexander
2,863,476 A 12/1958 Clark
2,864,420 A 12/1958 Schmidt
3,194,543 A 7/1965 McIlvaine
3,254,687 A 6/1966 Tertyshnikov
3,367,585 A 2/1968 Ratkowski
3,436,028 A 4/1969 Koehnen et al.
3,509,924 A 5/1970 Newhouse, Jr.
3,642,214 A 2/1972 Blackwell, Jr.
3,844,494 A 10/1974 Hightower
3,907,016 A 9/1975 Nicholson et al.
4,000,859 A 1/1977 Whitney
4,060,961 A 12/1977 Anderson et al.
4,074,594 A 2/1978 Dall et al.
4,076,177 A 2/1978 Hirayama et al.
4,077,450 A 3/1978 Ackerman
4,077,573 A 3/1978 Kersey et al.
4,117,985 A 10/1978 Lazareck
4,129,260 A 12/1978 Baker
4,129,262 A 12/1978 Lowry
4,146,184 A 3/1979 Whitney
4,146,185 A 3/1979 Schober
4,162,769 A 7/1979 Lapointe
4,162,770 A 7/1979 Lewis
4,168,035 A 9/1979 Palm et al.
4,344,581 A 8/1982 Redemann
4,504,019 A 3/1985 Newell et al.
4,558,826 A 12/1985 Martinek
4,573,643 A 3/1986 Orphall et al.
4,688,731 A 8/1987 Hunt et al.
4,702,424 A 10/1987 Widlak
4,717,083 A 1/1988 Quast et al.
4,848,681 A 7/1989 Eriksson et al.
4,850,406 A 7/1989 Krautzberger
4,872,500 A 10/1989 Duffey et al.
4,915,310 A 4/1990 Stelk
4,917,314 A 4/1990 Manschwetus
4,922,977 A 5/1990 Colton et al.
4,967,969 A 11/1990 Griffith, III
4,982,904 A 1/1991 Greiner
5,002,233 A 3/1991 Williams
5,042,727 A 8/1991 Plante
5,044,567 A 9/1991 Hte et al.
5,078,328 A 1/1992 Willingham
5,114,085 A 5/1992 Inui
5,205,496 A 4/1993 O'DOnnell et al.
5,209,278 A 5/1993 Carpenter et al.
5,285,974 A 2/1994 Cesarini
5,372,316 A 12/1994 Bateman
5,377,919 A 1/1995 Rogers et al.
5,392,999 A 2/1995 Konig et al.
5,413,286 A 5/1995 Bateman
5,474,239 A 12/1995 Williams, Jr. et al.
5,507,441 A 4/1996 De Boef et al.
5,526,988 A 6/1996 Rine
5,529,249 A 6/1996 Braun et al.
5,611,496 A 3/1997 Fleenor
5,713,525 A 2/1998 Morey
5,743,314 A 4/1998 Puch
5,863,003 A 1/1999 Smith
6,047,912 A 4/2000 Smith
6,059,210 A 5/2000 Smith 3
14
16
17
12
24
30
32
34
36
38
40
44
45
46
47
50
57
62
74
94
96
98
100
102
104

REPLACEABLE RAKER ASSEMBLY FOR PROCESSING TOOL OF WASTE PROCESSING MACHINE

BACKGROUND OF THE INVENTION

1. Field of the Invention

The present invention relates generally to waste processing machines and, more particularly, to a replaceable raker assembly for a processing tool of a waste processing machine.

2. Description of the Related Art

It is known to provide waste processing machines to reduce waste material. The waste processing machine typically includes a rotor assembly for reducing the waste material as the rotor assembly rotates. An example of such a rotor assembly for a waste processing machine is disclosed in U.S. Pat. No. 5,863,003, Issued Jan. 26, 1999, to Smith, entitled "WASTE PROCESSING MACHINE", the disclosure of which is hereby incorporated by reference. In that patent, the rotor assembly includes a rotor having a plurality of spaced pairs of mounting arms. The rotor assembly also includes a processing tool mounted to each pair of mounting arms. An example of such a processing tool is disclosed in U.S. Pat. No. 6,047,912, issued Apr. 11, 2000, to Smith, entitled "BREAK-AWAY PROCESSING TOOL FOR A WASTE PROCESSING MACHINE", the disclosure of which is hereby incorporated by reference. In that patent, the processing tool includes a tool holder attached to a rotor assembly by fasteners. The tool holder has a pair of spaced arms extending radially with a tool for reducing waste product attached to one arm and a wear bar or raker for depth limiting guiding attached to the other arm. Typically, the raker is a carbide member fixedly secured to the arm of the tool holder for the processing tool. The carbide member is disposed in a recess of the arm and secured thereto by brazing.

Although the above processing tool has worked well, it suffers from the disadvantage that the raker is fixed to the processing tool. If the raker is broken or needs replacing, the processing tool is unfastened and entirely removed from the rotor assembly. In addition, if a portion of the raker wears, it causes wear of the tool holder, and thus the entire processing tool must be replaced which is undesired. Therefore, there is a need in the art to provide a replaceable raker assembly for a processing tool of a waste processing machine that allows the raker to be replaced.

SUMMARY OF THE INVENTION

It is, therefore, one object of the present invention to provide a replaceable raker assembly for a processing tool of a waste processing machine.

It is another object of the present invention to provide a replaceable raker assembly for a processing tool of a waste processing machine that prevents wear of a tool holder of the processing tool.

To achieve the foregoing objects, the present invention is a replaceable raker assembly for a processing tool of a waste processing machine. The replaceable raker assembly includes a tool holder for attachment to a rotor assembly of the waste processing machine. The replaceable raker assembly also includes a raker removably attached to the tool holder to rake reduced waste material.

One advantage of the present invention is that a replaceable raker assembly is provided for a processing tool of a waste processing machine. Another advantage of the present invention is that the replaceable raker assembly allows the raker to be replaced without replacing the entire processing tool. Yet another advantage of the present invention is that the replaceable raker assembly has quick-change retention of the raker to a tool holder of the processing tool to prevent wear of the tool holder.

Other objects, features, and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
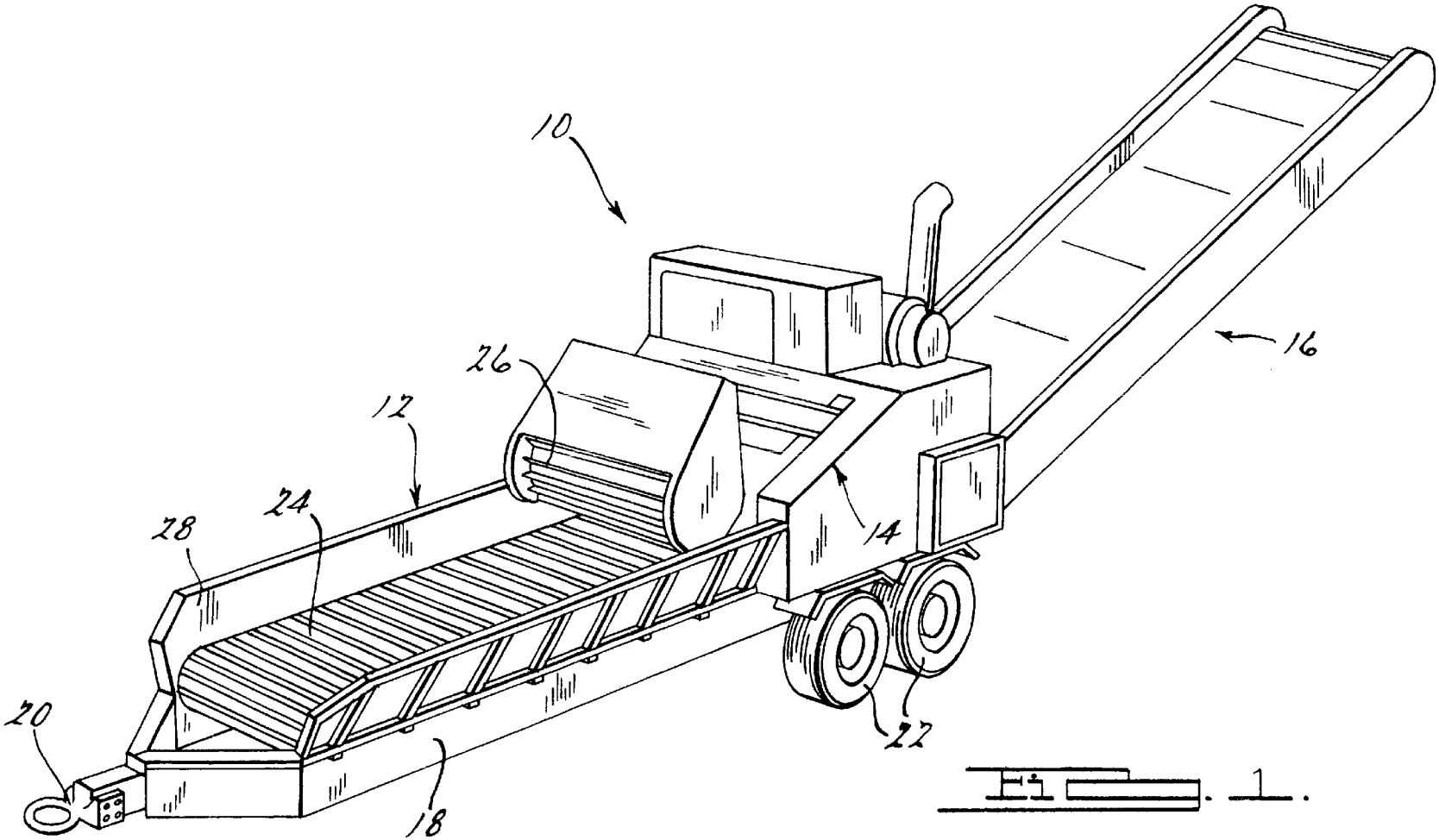
FIG. 1 is a perspective view of a waste processing machine.

Referring now to the drawings and in particular to FIG. 1, one embodiment of a waste processing machine 10 for reducing waste material is shown. The waste processing machine 10 includes an infeed system 12, a waste reducing system 14, and a discharge system 16. Waste material enters the waste processing machine 10 through the infeed system 12 where it is directed to the waste reducing system 14. The waste reducing system 14 reduces the waste material and directs it to the discharge system 16 where the reduced waste material is expelled from the waste processing machine 10. The waste processing machine 10 may be supported on a trailer framework 18 having a tongue mount 20 provided at a front thereof and wheels 22 near a rear of the framework 18. It should be appreciated that, with this structure, the infeed system 12 and waste reducing system 14 can be transported together while the discharge system 16 can be transported separately therefrom.

Figures 2, 5:
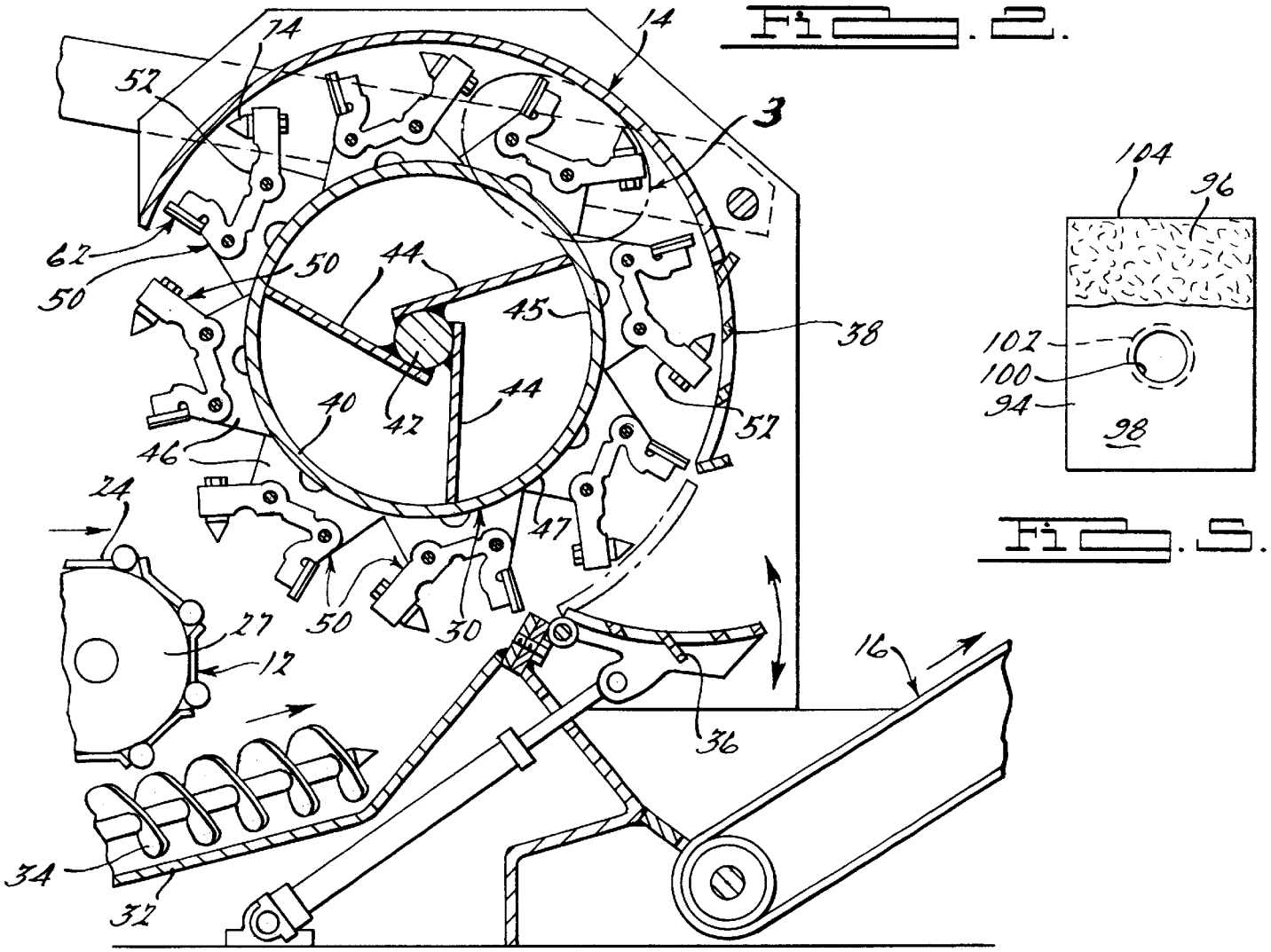
FIG. 2 is a fragmentary elevational view of a rotor assembly of the waste processing machine of FIG. 1.
FIG. 5 is a fragmentary elevational view of a raker of the replaceable raker assembly of FIG. 4.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 30 to be described of the waste reducing system 14. The infeed conveyor 24 is the sole means of support for the waste material and acts as a primary anvil for reducing the waste material by the rotor assembly 30 to be described. Opposed side walls 28 are provided on opposite sides of the conveyor 24 to contain the waste material. It should be appreciated that waste material is placed on the infeed conveyor 24, which moves the waste material into contact with the feed wheel assembly 26, which, in turn, rotates and feeds the waste material into contact with the rotor assembly 20 of the waste reducing system 14.

Figure 3:
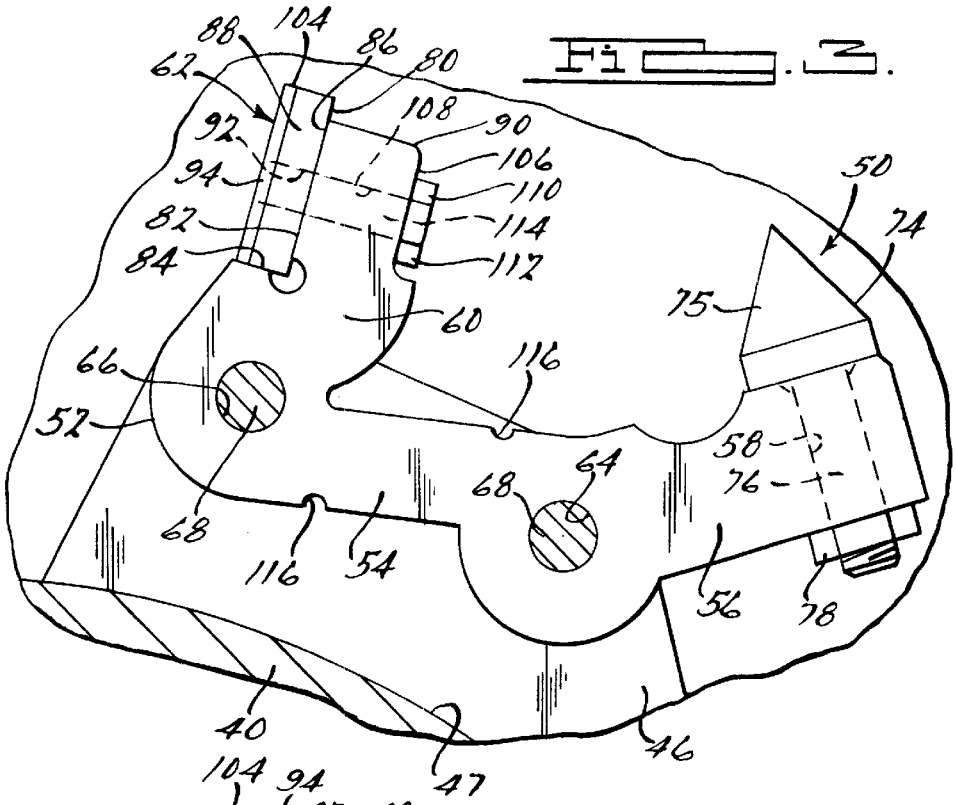
FIG. 3 is an enlarged fragmentary elevational view of a processing tool, according to the present invention, of the rotor assembly in circle 3 of FIG. 2.

Referring to FIGS. 2 and 3, the waste reducing system 14 includes a rotor assembly, according to the present invention and generally indicated at 30. The waste reducing system 14 also includes a housing 32 disposed about the rotor assembly 30 and a plurality of regrind augers 34 positioned at a bottom of the housing 32. The waste reducing system 14 further includes a movable concave screen 36 and a fixed concave screen 38. It should be appreciated that the waste reducing system 14 reduces waste material by the rotor assembly 30, which passes through the screens 36,38 to the discharge system 16. It should also be appreciated that the regrind augers 34 move reduced waste product into contact with the rotor assembly 30 for further reduction to pass through the screens 36,38.

The rotor assembly 30 also includes a rotatable rotor 40 disposed within the housing 32 above the regrind augers 34. The rotor 40 is a generally cylindrical tube having a longitudinal axis. The rotor 40 is mounted to a coaxially disposed shaft 42 by multiple braces 44 extending tangentially from an outer surface of the shaft 42 to an inner surface 45 of the rotor 40. Preferably, each brace 44 is an elongated plate-like member fixed tangentially to the shaft 42 by suitable means such as welding and is similarly secured to the inner surface 45 of the rotor 40 by suitable means such as welding. It should be appreciated that a power source (not shown) is connected to the shaft 42 in a well-known manner and is adapted to turn the shaft 42 and rotor 40.

Figure 4:
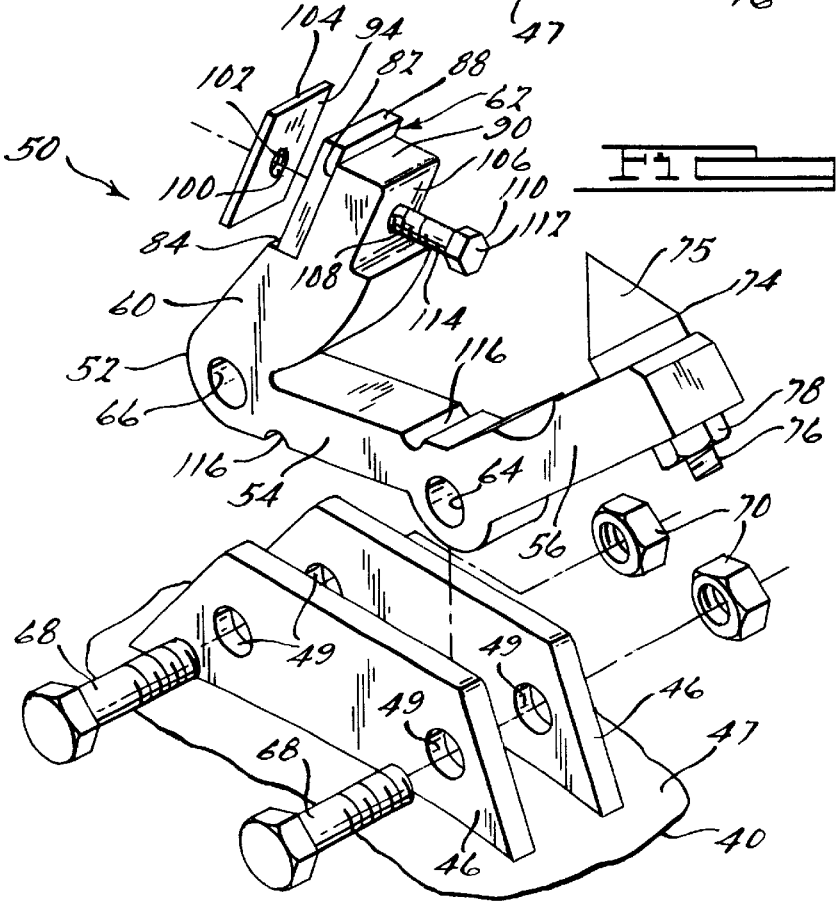
FIG. 4 is an exploded perspective view of a replaceable raker assembly, according to the present invention, of the processing tool of FIG. 3.

Referring to FIGS. 2 through 4, the rotor assembly 30 also includes a plurality of spaced pairs of mounting arms 46 mounted to an outer surface 47 of the rotor 40 by suitable means such as welding. Each mounting arm 46 is generally trapezoidal in shape and includes at least one, preferably a pair of spaced apertures 49 extending therethrough. The mounting arms 46 are wrapped about the rotor 40 in a first spiral and a second spiral spaced or offset from the first spiral. The rotor assembly 30 further includes a plurality of processing tools, according to the present invention and generally indicated at 50, mounted to the mounting arms 46. The first spiral and second spiral of mounting arms 46 extend about the rotor 40 so that in one rotation of the rotor assembly 30, every point on an imaginary axial line segment positioned adjacent to the rotor assembly 30 will be contacted by the processing tools 50 mounted to the rotor assembly 30.

Each of the processing tools 50, according to the present invention, includes a tool holder 52 having a general "C" shape. The tool holder 52 has a body 54 extending circumferentially and a first or trailing arm 56 extending radially at an angle therefrom with a first aperture 58 extending therethrough. The tool holder 52 also includes a second or leading arm 60 extending radially at an angle from the body 54 with a replaceable raker assembly, generally indicated at 62 and according to the present invention to be described, at one end thereof. The tool holder 52 includes an aperture 64 and 66 at a lower radial end of the first arm 56 and second arm 60, respectively, and extending axially therethrough. The body 54 has a width or thickness less than the first arm 56 and the second arm 60. The tool holder 52 is continuous, integral, unitary, and made as one-piece. It should be appreciated that the apertures 64,66 of the tool holder 52 are aligned with the apertures 49 of the mounting arms 46.

The rotor assembly 30 includes at least one, preferably a pair of fasteners such as bolts 68 and nuts 70 for retaining the processing tools 50 to the mounting arms 46. The bolts 68 extend through the apertures 49 in the mounting arms 46 and the apertures 64,66 of the tool holder 52 and threadably engage the nuts 70. It should be appreciated that the tool holder 52 is disposed between the mounting arms 46.

The processing tool 50 also includes a tool 74 attached to the tool holder 52. The tool 74 may be of a cutting, bullet, or fan type having a head 75 attached to a shaft 76 by suitable means such as brazing. The shaft 76 extends axially through the aperture 58 in the first arm 56 and is removably secured to the first arm 56 by suitable means such as a nut 78 threadably engaging the shaft 76. It should be appreciated that the tools 74 may be of a type disclosed in U.S. Pat. No. 6,059,210, issued May 9, 2000, to Smith, entitled "ROTOR ASSEMBLY FOR A WASTE PROCESSING MACHINE", the disclosure of which is hereby incorporated by reference.

Referring to FIGS. 2 through 5, the processing tool 50 also has a replaceable raker assembly 62, according to the present invention, removably attached to the second arm 60. The replaceable raker assembly 62 includes a raker 80 disposed in a recess 82 on a forward side of a free end of the second arm 60. The recess 82 is generally rectangular in shape and has a lower surface 84 and a side surface 86. The raker 80 includes a raker wear pad 88 disposed in the recess 82. The raker wear pad 88 is generally rectangular in shape. The wear pad 88 is of such a length to extend outwardly beyond a radial end surface 90 of the second arm 60 when disposed in the recess 82. The raker wear pad 88 rests against and is supported by the lower surface 84 and side surface 88. The raker wear pad 88 has an aperture 92 extending axially therethrough for a function to be described. The raker wear pad 88 is made of a metal material such as steel.

The raker 80 also includes wear bar 94 disposed in the recess 82 adjacent a forward side of the raker wear pad 88. The wear bar 94 is generally rectangular in shape. The wear bar 94 is of such a length to extend outwardly beyond a radial end surface 90 of the second arm 60 when disposed in the recess 82. Preferably, the wear bar 94 is the same length as the raker wear pad 88. The wear bar 94 rests against and is supported by the lower surface 84 of the recess and a front surface of the raker wear pad 88. The wear bar 94 includes a hard wear surface formed by carbide material 96 secured to a front or forward face 98 thereof by suitable means such as welding or brazing. The wear bar 94 has an aperture 100 extending axially therethrough for a function to be described. The aperture 100 includes a plurality of threads 102 therealong. The carbide material 96 is disposed between the aperture 100 and an outer radial end 104 of the wear bar 94. The wear bar 94 is made of a metal material such as steel.

The replaceable raker assembly 62 also includes another recess 106 on a rear side of a free end of the second arm 60 opposite the recess 82. The recess 106 is generally rectangular in shape. The replaceable raker assembly 62 includes an aperture 108 extending from the recess 106 to the recess 82 in the second arm 60. The replaceable raker assembly further includes a fastener such as a bolt 110 to removably secure the wear bar 94 and raker wear pad 88 to the second arm 60. The bolt 110 has a head 112 disposed in the recess 106 and a threaded shaft 114 extending axially from the head 112 and through the aperture 108 in the second arm 60 and the aperture 92 in the raker wear pad 88 and threadably engaging the threads 102 of the aperture 102. The bolt 110 is of a sufficient length to extend through the second arm 60 and raker wear pad 88 to engage the wear bar 94 in an unobstructed manner without penetrating the front face 98 of the wear bar 94. It should be appreciated that the second arm 60 operates as a depth-limiting guide and the first arm 56 operates as a cutter to reduce the waste material.

The processing tool 50 may include at least one notch 116 in the tool holder 52 to control breakage of the processing tool 50. Preferably, the processing tool 50 includes a first notch 116 in the body 54 adjacent to the first arm 56 between the first arm 56 and second arm 60 on a radial outer side thereof and a second notch 116 in the body 54 adjacent to the second arm 60 between the first arm 56 and second arm 60 on a radial inner side thereof. The notches 116 extend axially across the body 54 of the tool holder 52. The notches 116 are generally arcuate in shape and have a depth of approximately one-quarter inches (0.25 inches). The position, shape, and depth of the notches 116 are varied to control breakage of the tool holder 52 relative to either the first arm 56 or second arm 60 of the tool holder 52.

In operation, the processing tool 50 is rotated by the rotor 40. The tool 74 contacts waste product, such as a wooden log, first approximately three revolutions before the wear bar 94 contacts the waste product. If the waste product is stuck or lodged by the tool 74 in the waste processing machine 10, the first arm 56 will concentrate stress on the tool holder 52 in the notch 116 adjacent to the first arm 56 and cause a breakage by propagating a crack from the notch 116 radially across the body 54 of the tool holder 52. As such, the first arm 56 will then pivot about the bolt 68 which acts as a first pivot pin and remain attached to the mounting arms 46 to prevent damage to the rotor assembly 30. In addition, the remainder of the tool holder 52 including the body 54 and second arm 60 will pivot about the other bolt 68 which acts as a second pivot pin and remain attached to the mounting arms 46 to prevent damage to the rotor assembly 30. The tool holder 60 can then be replaced.

During operation, if the wear bar 94 becomes worn due to contact with the waste product, the bolt 110 may be removed by unthreading the threaded shaft 114 from the wear bar 94. The worn wear bar 94 can be discarded and replaced with a new wear bar 94. The bolt 110 is then threaded with the threads 102 of the aperture 100 to secure the wear bar 94 in place. It should also be appreciated that the raker wear pad 88 may be replaced if worn.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A replaceable raker assembly for a processing tool of a waste processing machine comprising:

a tool holder for attachment to a rotor assembly of the waste processing machine; and a raker removably attached to said tool holder to rake reduced waste material.

2. A replaceable raker assembly as set forth in claim 1 wherein said raker extends radially outwardly past said tool holder.

3. A replaceable raker assembly as set forth in claim 1 wherein said raker includes an aperture extending axially therethrough.

4. A replaceable raker assembly as set forth in claim 1 including a fastener extending through said aperture to attach said raker to said tool holder.

5. A replaceable raker assembly as set forth in claim 1 wherein said tool holder includes a recess to receive said raker.

6. A replaceable raker assembly as set in claim 5 wherein said raker comprises a raker wear pad disposed in said recess of said tool holder.

7. A replaceable raker assembly as set forth in claim 6 wherein said tool holder includes a pair of arms extending radially and said raker wear pad is attached to one of said arms.

8. A replaceable raker assembly as set forth in claim 6 wherein said raker further comprises a wear bar disposed in said recess adjacent said raker wear pad.

9. A replaceable raker assembly as set forth in claim 8 wherein said wear bar includes a carbide material attached thereto to reduce wear of said raker wear pad.

10. A replaceable raker assembly as set forth in claim 9 wherein said carbide material is welded to a front surface of said wear bar.

11. A replaceable raker assembly as set forth in claim 9 wherein said carbide material is disposed between an aperture and a radial end of said raker wear pad.

12. A processing tool for a waste processing machine comprising:

a tool holder for attachment to a rotor assembly of the waste processing machine;

a reducing tool attached to said tool holder to reduce waste material; and a replaceable raker assembly removably attached to said tool holder.

13. A processing tool as set forth in claim 12 wherein replaceable raker assembly comprises a raker wear pad to rake reduced waste material and a fastener to removably attach said raker wear pad to said tool holder.

14. A processing tool as set forth in claim 13 wherein said replaceable raker assembly includes a wear bar disposed adjacent said raker wear pad and having a carbide material attached thereto to reduce wear of said raker wear pad.

15. A processing tool as set forth in claim 14 wherein said raker wear pad includes a first aperture extending axially therethrough and said wear bar includes a threaded second aperture, said fastener extending through said first aperture and threadably engaging said second aperture to attach said raker wear pad and said wear bar to said tool holder.

16. A processing tool as set in claim 15 wherein said raker wear pad and said wear bar extend radially outwardly past said tool holder.

17. A processing tool as set forth in claim 16 wherein said tool holder includes a recess to receive said raker wear pad and said wear bar.

18. A processing tool as set forth in claim 17 wherein said carbide material is disposed between said second aperture and a radial end of said wear bar.

19. A processing tool for a waste processing machine comprising:

a tool holder for attachment to a rotor assembly of the waste processing machine, wherein said tool holder includes a first arm extending radially and a second arm extending radially and spaced from said first arm;

a reducing tool attached to said first arm of said tool holder to reduce waste material; and a replaceable raker assembly removably attached to said second arm of said tool holder, wherein replaceable raker assembly comprises a raker wear pad and a wear bar to rake reduced waste material, said wear bar having a carbide material attached thereto to reduce wear of said raker wear pad, and a fastener extending through said second arm and said raker wear pad and engaging said wear bar.

* * * * *

UNITED STATES PATENT AND TRADEMARK OFFICE

CERTIFICATE OF CORRECTION

PATENT NO. : 6,517,020 B1
DATED : February 11, 2003
INVENTOR(S) : Leward N. Smith It is certified that error appears in the above-identified patent and that said Letters Patent is hereby corrected as shown below:

Column 4,
Line 23, "surface 88" should read -- surface 86 --.

Signed and Sealed this

Twenty-ninth Day of July, 2003

JAMES E. ROGAN
*Director of the United States Patent and Trademark Office*